US005586752A

United States Patent [19]

Wada et al.

[11] Patent Number: 5,586,752

[45] Date of Patent: Dec. 24, 1996

[54] LOAD CHAIN RETAINMENT FOR A CHAIN BLOCK

[75] Inventors: Yasuo Wada; Yoshio Ueno, both of Sayama, Japan

[73] Assignee: Elephant Chain Block Company Limited, Osaka, Japan

[21] Appl. No.: 270,659

[22] Filed: Jul. 5, 1994

[30] Foreign Application Priority Data

Jul. 2, 1993 [JP] Japan ..... 5-164894

[51] Int. Cl.[6] ..... B66D 1/30

[52] U.S. Cl. ..... 254/372

[58] Field of Search ..... 254/372, 333, 254/329, 332, 342, 346, 347, 357, 358

[56] References Cited

U.S. PATENT DOCUMENTS

| | | | |
|---|---|---|---|
| 1,403,712 | 1/1922 | Schaudies | 254/372 |
| 1,572,001 | 2/1926 | Dotzert | 254/323 X |
| 1,576,986 | 3/1926 | Mullen | 254/358 |
| 2,477,783 | 8/1949 | Britt . | |
| 2,570,833 | 10/1951 | Metcalf et al. . | |
| 2,704,201 | 3/1955 | Robins | 254/372 |
| 5,316,267 | 5/1994 | Nishi et al. | 254/372 X |

FOREIGN PATENT DOCUMENTS

| | | | |
|---|---|---|---|
| 516846 | 4/1921 | France . | |
| 829959 | 7/1938 | France . | |
| 49-42601 | 11/1974 | Japan . | |
| 405124794 | 5/1993 | Japan | 254/358 |

*Primary Examiner*—Daniel P. Stodola
*Assistant Examiner*—Emmanuel M. Marcelo
*Attorney, Agent, or Firm*—Watson Cole Stevens Davis, P.L.L.C.

[57] ABSTRACT

A manual chain block having a hand wheel and hand chain on one axial end and a load wheel and load chain on the other axial end. A no-load side chain guide (44) of the load chain guides (43, 44)is provided with an anchoring portion (45) for anchoring a no-load end portion of a load chain (4). An anchoring portion (45) is provided with a load receiving portion (46) for receiving a load acting on the no-load side end portion.

6 Claims, 4 Drawing Sheets

LOAD CHAIN RETAINMENT FOR A CHAIN BLOCK

FIELD OF THE INVENTION

The present invention relates to a manual chain block, and more specifically to a manual chain block having a load sheave supported rotatably between a pair of side plates so as to be driven interlockingly by a manual actuating device such as a hand wheel and the like.

BACKGROUND OF THE INVENTION

Conventionally, for example as shown in attached FIG. 9 and as disclosed in the Japanese Utility Model Publication No. Sho. 49 (1974)-42601, the disclosure of which is hereby incorporated by reference, a manual chain block has a load sheave supported rotatably between a pair of side frames so as to be driven interlockingly by a manual actuating device comprising a hand wheel and a hand chain and a load chain which is looped around the load sheave and has a hook on its load side with its no-load side anchored to an anchoring pin 102 disposed between the side frames 101. Further, between the side frames 101 there is provided a load chain guide 105 for making the load chain 104 mesh smoothly with the load sheave 103. When the load sheave 103 is driven to rotate by an operation of the hand chain of the manual actuating device, the load side portion 104*a* of the load chain 104 is raised or lowered so as to lift or lower a cargo by the hook of its load side end portion.

When lowering the cargo by unwinding the load side portion 104*a* of the load chain 104, since an end of the no-load portion 104*b* is anchored to pin 102, the no-load side portion 104*b* anchored to the anchoring pin 102 takes merely a tensioned state so as to be prevented from further unwinding even though the load side portion 104*a* of the load chain 104 has been unwound for lowering to the utmost limit.

OBJECTIVES OF THE INVENTION

As mentioned above, the further unwinding of the load chain 104 is prevented during lowering of the cargo by anchoring the no-load side end of the chain 104 to the anchoring pin 102. But since the unwinding of the load chain 104 is carried out by rotating the load sheave 103 through the operation of the hand chain, when an operator continues to operate the hand chain without noticing the unwinding limit, there appears a problem that a bending moment acts concentrically on the anchoring pin 102 to deform the pin 102. Further, since the anchoring pin 102 is disposed separately and off to one side from the load chain guide 105 and secured between the side frames 101, not only is the number of the component parts increased but also it is necessary to assemble it to the side frames 101 individually, so the assembly is difficult.

Further, in the conventional embodiment described in the above mentioned publication, as shown in FIG. 9, in case that the no-load side portion 104*b* of the load chain 104 becomes abnormally tensioned, in order to prevent that the no-load side portion 104*b* is brought into abnormal contact with the load chain guide 105 and then the no-load side portion 104*b* is subjected to a bending stress tending to deform it, the anchoring pin 102 is disposed outside the load sheave 103 in the tangential direction, namely at such a position as not to be subjected to the bending stress produced by the load chain guide 105 but to be tensioned linearly. Therefore, a deformation of the no-load side portion 104*b* can be minimized. But, since a stay bolt 106 for joining together the side plates 101 is disposed below the load sheave 103 as well as a chain kicker 107 extends toward the load sheave 103 from the stay bolt 106, when the no-load side portion 104*b* is relaxed from the tensioned state due to the winding of the load chain 104 and then hangs downward, there is a problem in that the no-load side portion 14*b* can not hang smoothly because it interferes with the stay bolt 106 and the chain kicker 107 may be clogged thereby.

It is an object of the present invention to provide a manual chain block in which a no-load side portion of a load chain can be strongly anchored without any deformation, the structure can be simplified, the assembling can be improved and the no-load side portion of the load chain can hang smoothly during winding up of the load chain.

BRIEF DESCRIPTION OF PREFERRED EMBODIMENTS

Figure 1:
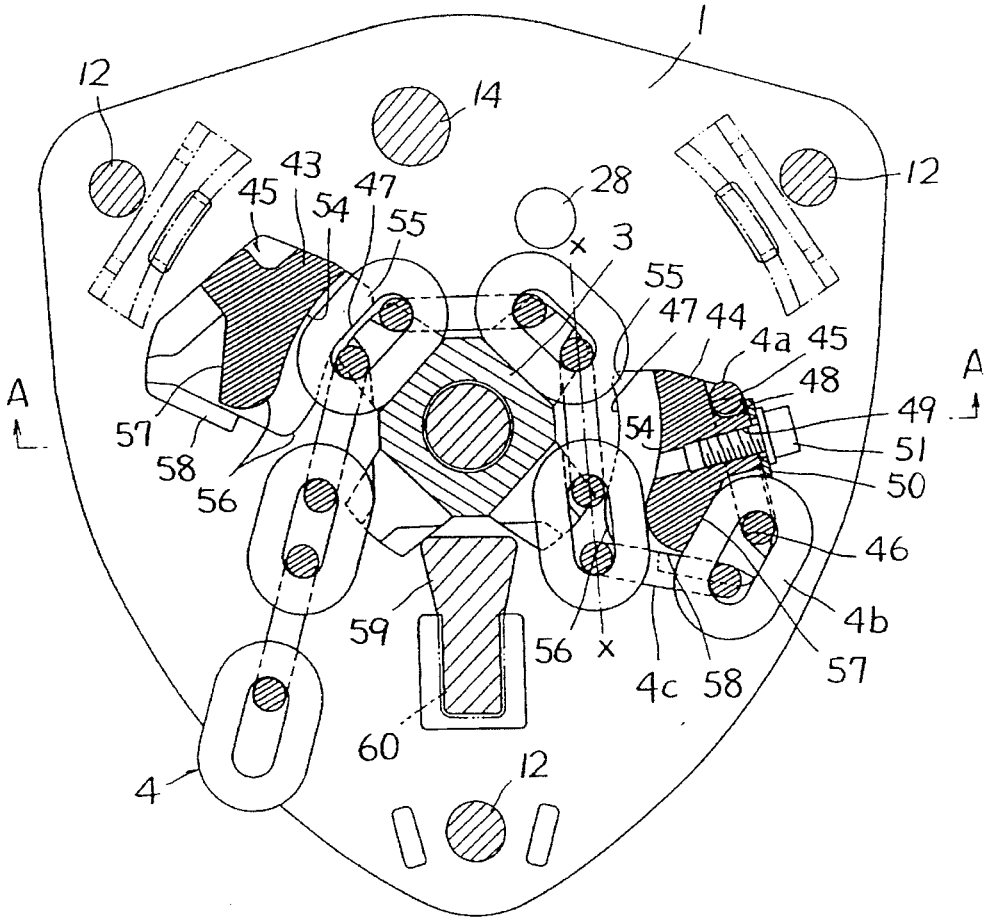
FIG. 1 is an elevational view, partly in sectional view shown in a state where a load chain is looped around a load sheave.

A preferred embodiment includes a manual chain block which has a load sheave 3 supported rotatably between a pair of side plates 1, 2 so as to be driven interlockingly by a manual actuating device 20. Between the side plates 1, 2 there is provided a pair of load chain guide 43, 44 adapted to guide a load chain coming up to the load sheave 3 so as to force the chain toward the load sheave 3 and that the no-load side chain guide 44, serving to guide the no-load side portion of the load chain has an anchoring portion 45 adapted to anchor the no-load side end portion of the load chain and the anchoring portion 45 has a load receiving portion 46 adapted to receive a load acting on the no-load side end portion of the load chain.

The invention also includes a manual chain block in which the no-loaded side chain guide 44 is provided with a vertical link receiving portion 57 adapted to receive a vertical link 4*b* connecting to the no-load side end anchored to the anchoring portion 45 and transferring to the load sheave 3 and a horizontal link receiving portion 58 adapted to receive a horizontal link 4*c*.

The invention further includes a manual chain block in which each chain guide 43, 44 has a chain deviation restraining portion 55 disposed in such a portion thereof as to face the load sheave 3 on the rear side in the approaching direction of the load chain relative to the load sheave 3 so as to serve to restrain a radially outward deviation of the chain relative to the load sheave 3 on that rear side.

The invention also concerns a manual chain block in which each chain guide 43, 44 has a guide portion 56 disposed in a portion thereof so as to face the load sheave 3 on the fore side in the approaching direction of the load chain relative to the load sheave 3 so as to correct a twist of the load chain coming up to the load sheave 3.

Since the anchoring portion 45 provided with the load receiving portion 46 is disposed in the no-load side chain guide 44 of the pair of load chain guides 43, 44, even in case that the no-load side portion of the load chain is excessively tensioned by an unwinding of the load chain beyond the unwinding limit or by elimination of a traction thereon, the no-load side end portion of the load chain is received by the load receiving portion 46. Therefore, it is possible to prevent deformation of the anchoring portion 45 effectively so as to improve its durability. Further, since the anchoring portion 45 is provided in the no-load side chain guide 44, it is unnecessary to provide an anchoring member such as the anchoring pin positioned to one side from the load chain guide differently from the conventional embodiment, so that the number of component parts can be reduced by that portion, the structure can be simplified and the assembling can be simplified to attain reduced cost. Since the anchoring portion 45 is provided in the no-load side chain guide 44, it is possible to make the no-load side portion of the load chain hang smoothly when the no-load side portion of the chain is relaxed from the tensioned state when carrying out an unwinding operation. Accordingly, it is possible to resolve the problem that the no-load side portion of the chain clogs beside the load sheave.

Since the vertical link receiving portion 57 and the horizontal link receiving portion 58 are provided in the no-load side chain guide 44 so as to be arranged continuously in series from the anchoring portion 45, it is possible to prevent both deformation of the no-load side portion of and excessive tensioning of the chain. Since the position of the anchoring portion 45 for anchoring the end of the no-load side portion of the load chain can be brought to the side opposed to the chain guide surface of the chain guide 44, it becomes possible to hang the no-load side portion of the chain more smoothly when the no-load side portion of the chain is made to relax when unwinding the load chain 4 and so on.

Since the chain deviation restraining portion 55 is disposed in each load chain guide 43, 44, these deviation restraining portions 55 can restrain the load chain which is apt to deviate radially outwards from the load sheave 3 (due to gravity) at the position where the load chain passes through the load chain guide 44 in the case of conveyance of the chain block or traction of the load chain under the load or reversed condition of the side plates 1, 2. Therefore, the load chain 4, having passed through the load sheave 3, can be kept looped around the load sheave without deviation so as to be pulled out without clogging. When the load chain is pulled out by operating the manual actuating device 20, it is possible to prevent the load chain from deviating and interfering with the stay bolt or to prevent the load sheave from being locked by clogging.

The guide portion 56 is disposed in each load chain guide 43, 44, and thus it is possible to correct a twist of the load chain forcibly by the guide portion 56 even though the chain approaches the load sheave 3 in the twisted state.

Accordingly, it becomes possible to prevent the load chain from being locked by catching in the fore portions of the load chain guides 43, 44 in the approaching direction.

DETAILED DESCRIPTION OF THE INVENTION

Figure 2:
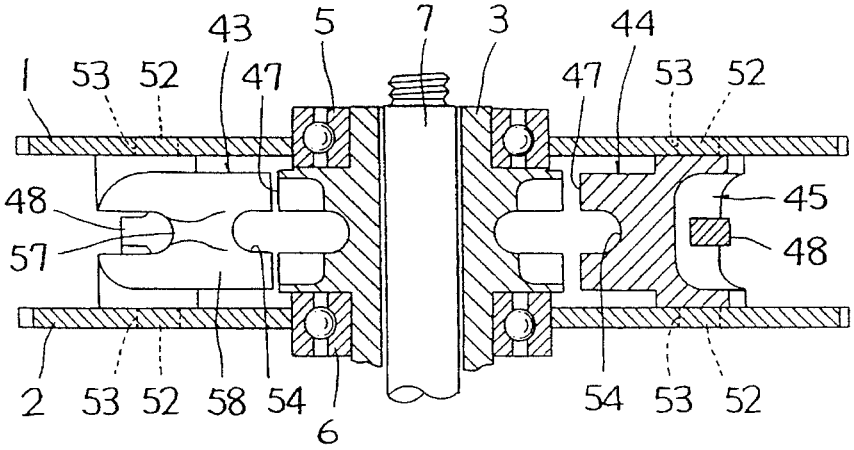
FIG. 2 is a vertical sectional view taken along line A—A in FIG. 1.
Figure 3:
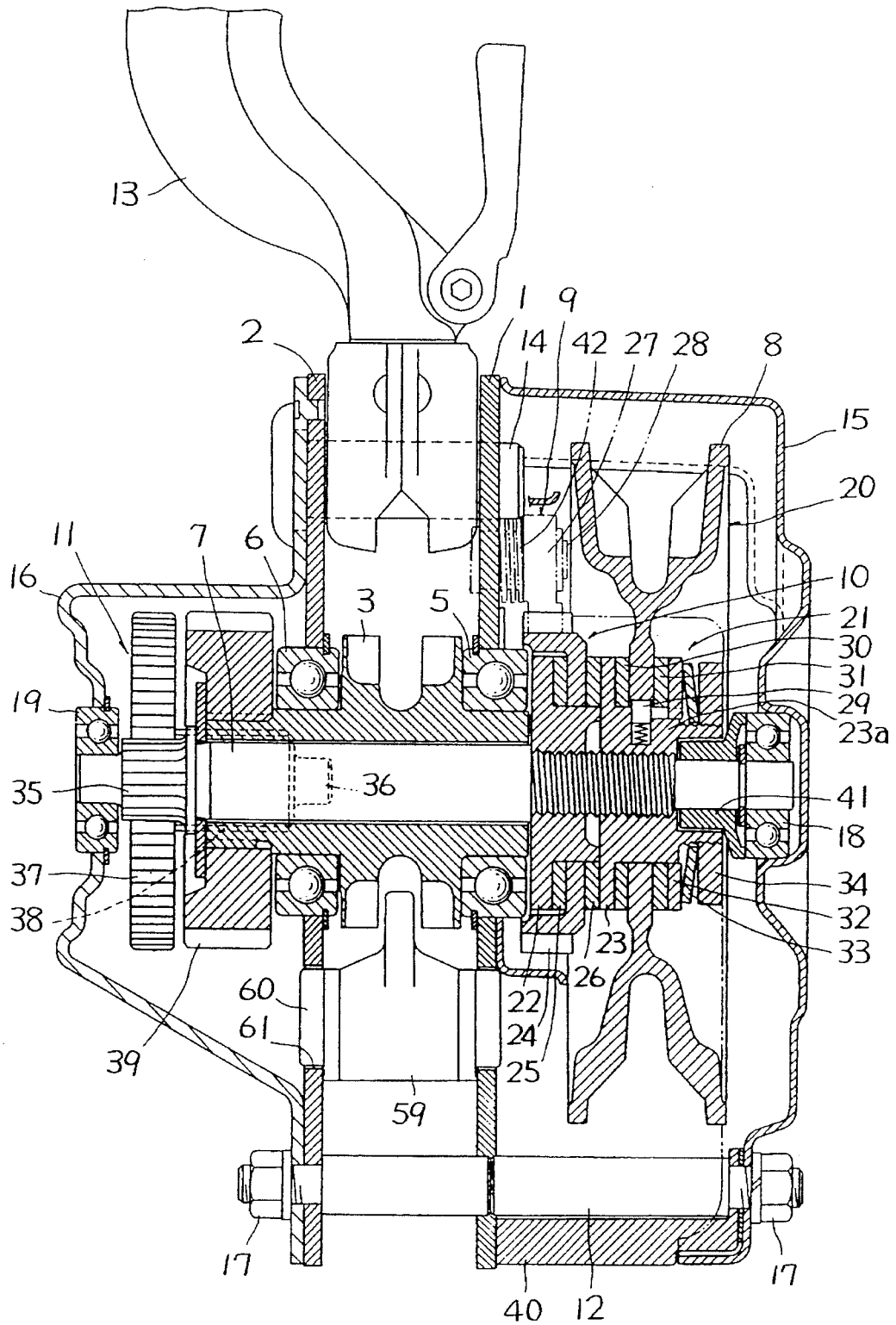
FIG. 3 is a vertical sectional view taken parallel to the axis of rotation of a manual chain block of the present invention.

A manual chain block illustrated in FIGS. 1 and 2 is a manually lifting and lowering type chain block which has a load sheave 3 rotatably supported between a pair of side plates 1, 2 through bearings 5, 6 so that a load chain 4 is looped therearound. FIG. 3 shows a driving shaft 7 passed through a shaft bore of the load sheave 3 and is provided at one axial end with a hand wheel 8 around which an endless hand chain (not illustrated) is looped. A transmission mechanism 10 provided with a mechanical brake 9 is provided between the hand wheel 8 and the driving shaft 7 while the driving shaft 7 is provided at its other axial end with a reduction gear mechanism 11 comprising a plurality of reduction gears so that a driving force can be transmitted to the load sheave 3 through the transmission mechanism 10 and the reduction gear mechanism 11 by an actuating operation of the hand wheel 8 through the hand chain so as to lift or lower a hanging member such as a hook connected to a load side portion of the load chain 4 looped around the load sheave 3.

The side plates 1, 2 are fixedly secured by three spaced apart stay bolts 12 and an attachment shaft 14 to which a hook 13 is attached is mounted between upper portions of side plates 1, 2 on one side in the tangential direction of the load sheave 3.

A wheel cover 15 for covering the hand wheel 8 is attached to the outside of the side plate 1 while a gear cover 16 for covering the reduction gear mechanism 11 is attached to the outside of the side plate 2. Both these cover 15, 16 are fixedly secured by nuts 17 threadably engaged with the stay bolts 12.

The wheel cover 15 and the gear cover 16 are provided with bearings 18, 19 respectively so that the opposite ends of the driving shaft 7 are supported rotatably separately from the load sheave 3 by the respective covers 15, 16 through the bearings 18, 19. A predetermined clearance for relative rotation is maintained between the driving shaft 7 and the shaft bore of the load sheave 3 supported rotatably by the side plates 1, 2 through the bearings 5, 6.

The hand chain, the hand wheel 8 and the transmission mechanism 10 constitute the manual actuating device 20, and an overload preventive mechanism 21 is provided in the embodiment shown in FIGS. 1 and 2.

The transmission mechanism 10 comprises a driven hub 22 mounted to the drive shaft 7 so as not to rotate relatively thereto (threadably jointed to each other in FIG. 3), a driving member 23 threadably engaged with the driving shaft 7, a reverse preventive gear 24 interposed between the respective flange portions of the driven hub 22 and the driving member 23 and supported rotatably by the driven hub 22 and lining plates 25, 26 interposed respectively between the driven hub 22 and the reverse preventive gear 24 and between the reverse preventive gear 24 and the driving member 23. A reverse preventive pawl 27 meshed with the reverse preventive gear 24 is swingably mounted to the side plate 1 by the pawl shaft 28. This reverse preventive pawl 27, the reverse preventive gear 24, the hub 22, the driving member 23 and the lining plates 25, 26 comprise the mechanical brake 9.

The overload preventive mechanism 21 has the hand wheel 8 supported by a cylindrical boss **23*a* of the driving member 23 through a one way clutch 29 so as to be rotatable in the normal driving direction, a lining plate 30 disposed between the flange portion of the driving member 23 and a boss portion of the hand wheel 8, a lining plate 31 and a press plate 32 rotatable together with the cylindrical boss portion 23***a* and a resilient member 33 comprising an initially coned disc spring 33 put onto the cylindrical boss portion 23*a* of the driving member 23 in order outside the hand wheel 8, and an urging force setting adjuster 34 threadably engaged with an end of the boss portion 23*a* outside the resilient member 33 so as to optionally set a slip load of the hand wheel 8 relative to the driving member 33 by adjusting an urging force of the resilient member 33.

Further, the reduction gear mechanism 11 comprises a first gear 35 formed integrally with a shaft end of the driving shaft 7, a pair of second gears 37, 37 supported by intermediate shafts 36, 36 respectively so as to mesh with the first gear 35, a pair of third gears 38, 38 provided in the intermediate shafts 36, 36 and a fourth gear 39 connected to an extended portion of the load sheave 3 so as to mesh with the third gears 38, 38.

Incidentally, in FIG. 3, the numeral 40 designates a cover holding member for the wheel cover 15 and numeral symbol 41 designates a wheel stopper interposed between an axial end surface of the driving member 23 and an outer ring 18*a* of the bearing 18 so as to provide a limit for an axial outward movement of the hand wheel 8 through the driving member 23. The symbol 42 designates a pawl spring for urging the reversal preventive pawl 27 toward the reversal preventive gear 24.

Thus, in the above mentioned construction, when the hand wheel 8 is driven in the normal direction by operating the hand chain, the driving shaft 7 is driven through the transmission mechanism 10 having the over-load preventive mechanism 21 and the mechanical brake 9 so that the driving force is transmitted to the load sheave 3 through the reduction gear mechanism 11 to rotate the load sheave 3. Thereupon, the load side portion of the load chain 4 looped around the load sheave 3, namely the load side portion having a hook attached to its leading end thereof for hanging a cargo can be wound to lift the cargo.

When a load larger than the slip load set by the adjuster 34 of the overload preventive mechanism 21 acts on the load side portion of the load chain 4 at the time of lifting the cargo, the hand wheel 8 slips relative to the driving member 23 so that the cargo lifting there after is stopped. Thereupon, the level of the cargo lifted thus far is held by action of the mechanical brake 9.

When the lifted cargo is lowered, the hand chain is operated so as to drive the hand wheel 8 in the reverse direction. Thereupon, the driving member 23 is retreated due to a screw effect by the reverse driving of the hand wheel 8, so that the load sheave 3 is rotated in reverse by alternately repeating an action and an inaction of the mechanical brake 9 to carry out the cargo lowering gradually.

In the manual chain block having the above mentioned construction according to the present invention as shown in FIG. 1, between the side plates 1, 2 there is provided the pair of load chain guides 43, 44 adapted to guide the load chain 4 coming up to the load sheave 3 so as to force the chain toward the load sheave 3 while as shown in FIG. 1 and FIGS. 3 through 8, the no-load side chain guide 44, serving to guide the no-load side portion of the chain 4, of those chain guides 43, 44 has an anchoring portion 45 adapted to anchor the no-load side end portion of the load chain 4 and the anchoring portion 45 has a load receiving portion 46 adapted to receive a load acting on the no-load side end portion of said load chain 4.

The anchoring portion 45 is provided in the outside of the chain guide 43, namely in the rear face thereof on the side opposed to the chain pushing surface 47 and has a protruded portion 48 formed in the central portion thereof so as to enter the horizontal link 4*a* as the no-load side end portion of the load chain 4. A threaded hole 49 is formed in the protruded portion 48, so that the horizontal link 4*a* engaged with the protruded portion 48 can be fixedly secured through a fixing plate 50 applied onto the outside of the horizontal link 4*a* by tightening a fixing bolt 51 into the threaded hole 49. The load receiving portion 46 is provided below the protruded portion 48 as an arcuate receiving stepped portion having the same configuration as the lower end portion of the horizontal link 4*a* anchored to the anchoring portion 45, so that a load applied to the horizontal link 4*a* from the vertical link 4*b* connected thereto can be received by the receiving stepped portion engaged with a periphery of the end portion of the horizontal link 4*a*.

Accordingly, when the load chain 4 is unwound to the utmost limit, since the no-load side end portion thereof is anchored to the anchoring portion 45, it is tensioned between the load sheave 3 and the anchoring portion 45 so that unwinding is no longer carried out. When an operator further operates the load chain under that condition without notice that the unwinding limit has already been reached come, namely when an excessive unwinding is carried out, a large load acts on the no-load side end portion anchored to the anchoring portion 45 and then a large load can be received by the load receiving portion 46 provided in the load chain guide 44. Accordingly, since the load chain guide 44 is formed as an integral member and its durability is increased by a heat treatment, it is not deformed by the load. Further, since the outer periphery of the horizontal link 4*a* anchored to the anchoring portion 45 is received by the load receiving portion 46, it becomes possible to support the load without any breakage of the link 4*a* under a sufficiently durable arrangement.

Further, since the anchoring portion 45 and the load receiving portion 46 are provided in the no-load side chain guide 44 it is unnecessary to provide the anchoring pin separately aside from the load chain guide differently from the conventional embodiment. Therefore, the number of the component parts can be decreased by that portion, the structure can be simplified and the assemblings, of the side plates 1, 2 can be simplified, so that cost decrease can be attained. Incidentally, in the embodiment shown in FIGS. 1 and 2, the load side chain guide 43 is so formed as to have the same configuration as that of the no-load side chain guide 44 for use in common. But the anchoring portion 45, the load receiving portion 46, the vertical link receiving portion 57 and the horizontal link receiving portion 58 are not used in the load side chain guide 43.

As shown in FIGS. 4 through 8, the load chain guides 43, 44 have square projections 52 formed in their opposed side surfaces while the side plates 1, 2 have square ports 53 into which the square projections are fitted as shown in FIG. 2, so that the guides 43, 44 can be fixedly secured between the side plates 1, 2 by fitting the square projections 52 into the square ports 53 and fixing the side plates 1, 2 by the stay bolt 12.

A groove 54 for guiding the vertical link 4*b* of the load chain 4 is formed in the surface of the load chain guide 43 facing the load sheave 3. Both the bottom portion of the groove 54 and the load sheave facing portions positioned on opposite sides of the groove 54 are formed in such an arcuate shape as to face inwards to an axis of the load sheave 3 at its center so as to provide the chain pushing surface 47 serving to force the load chain 4, which is to enter between the side plates 1, 2 and mesh with the load sheave 3, toward the load sheath 3.

Chain deviation restraining portions 55 are formed in the chain pushing surface 47 on its rear side in the approaching direction of the load chain 4 of the load sheave 3 so as to restrain a radially outward deviation of the load chain 4 relative to the load sheave 3 on that rear side. Guide portions 56 are formed in the chain pushing surface 47 on the fore side in the approaching direction of the load chain 4 so as to forcibly correct a twist of the load chain 4 when the load chain 4 enters between the side plates 1, 2 in the twisted state.

The chain deviation restraining portions 55 are formed by protruding the rear portion of the chain pushing surface 47 in such a shape as to run along a revolution orbit of the load sheave 3 so as to restrain a deviation of the load chain 4 when the chain 4 running under the guidance of the chain pushing surface 47 is going to deviate radially outwards relative to the revolution orbit of the load sheave 3.

The guide portions 56 are formed by swelling out the fore portion of the chain pushing surface 47 in such an arcuate shape as to face outwards contrarily to the arcuate shape of the pushing surface 47 facing inwards so as to correct a twisted state of the load chain 4 by making use of a tension force generated by the rotation of the load sheave 3 when the vertical link and the horizontal link of the chain 4 are brought into contact with the guide portions 56, so that the twist can be resolved.

Figure 4:
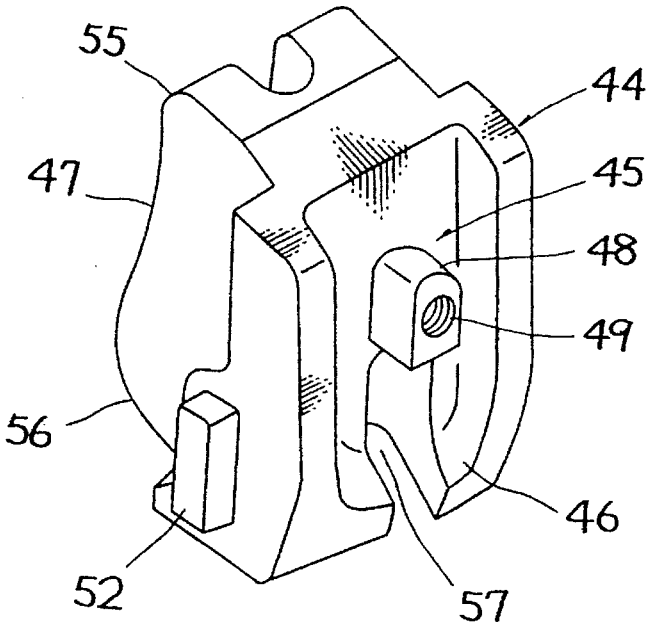
FIG. 4 is a perspective view of a no-load side chain guide viewed from the outside.
Figure 5:
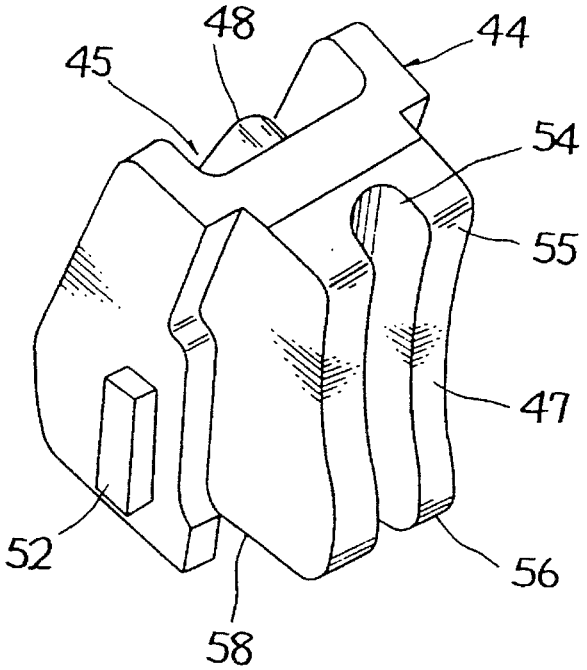
FIG. 5 is a perspective view of the no-load side chain guide viewed from the inside.
Figure 6:
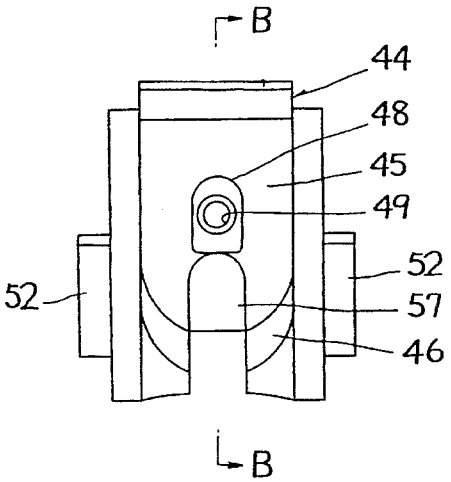
FIG. 6 is a side view of the no-load side chain guide viewed from the outside.
Figure 7:
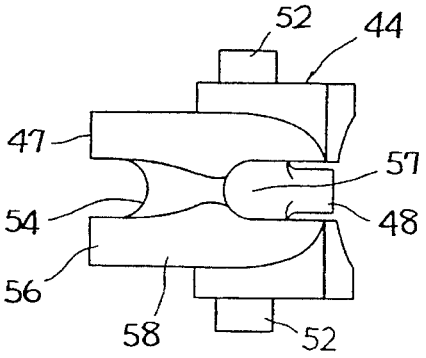
FIG. 7 is a bottom view of the no-load side chain guide viewed from below.
Figure 8:
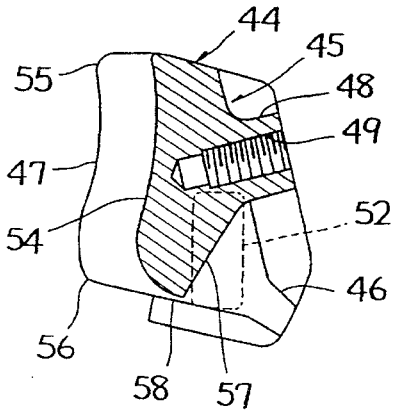
FIG. 8 is a sectional view taken along line B—B in FIG. 6.
Figure 9:
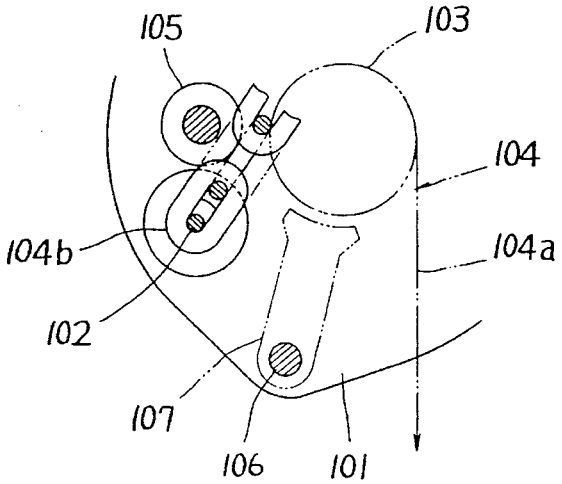
FIG. 9 is an explanatory view showing a prior art manual chain block.

The no-load side chain guide 44 having the anchoring portion 45 of the load chain guides 43, 44 is provided with a vertical link receiving portion 57 for receiving the vertical link **4*b* connected to the horizontal link 4*a* as the no-load side end portion of the load chain 4 anchored to the anchoring portion 45 and the horizontal link receiving portion 58 for receiving a horizontal link 4*c* on the side of the load sheave 3, connected to that vertical link 4*b*. As shown in FIG. 4 and FIGS. 6 though 8, the vertical link receiving portion 57 is formed like a groove in a corner defined by both the back surface and the lower surface of the chain guide 44 so as to be continuous with a concave portion for forming the load receiving portion 46 in the anchoring portion 45, namely a concave portion for forming the receiving stepped portion so that the vertical link 4*b* can enter therein. The horizontal link receiving portion 58 is provided in the lower surface of the chain guide 44 so as to be continuous with the vertical link receiving portion 57. Accordingly, the outside portion of the vertical link 4*b* is received by the vertical link receiving portion 57 and the upper portion of the horizontal link 4*c* is received by the horizontal link receiving portion 58**.

Therefore, when the no-load side portion of the load chain 4 anchored to the anchoring portion 45 is tensioned and the load is received by the load receiving portion 46, since the vertical link **4*b* connected to the horizontal link 4*a* anchored to the anchoring portion 45 and the horizontal link 4*c* connected to the vertical link 4*b* both of which are arranged in order toward the load sheave 3 are received by the link receiving portions 57, 58 respectively as shown in FIG. 1, it becomes possible to effectively prevent deformations of the vertical link 4*b* and the horizontal link 4*c*** even in the case of the large load.

Incidentally, the numeral 59 in FIGS. 1 and 2 designates a chain kicker secured between the side plates 1, 2 directly below the load sheave 3 so as to restrain the load chain 4 from entering between the side plates 1, 2 and meshing with the load sheave 3 from inclining in the entering direction. The chain kicker 59 has square projections 60 formed on its opposite sides similarly to the load chain guides 43, 44 and fitted into square ports 61 formed in the side plates 1, 2 so as to be fixedly secured between the side plates 1, 2 together with the load chain guides 43, 44.

Thus, since the load chain guides 43, 44 are integrally formed as mentioned above and have chain pushing surfaces 47 as well as chain deviation restraining portions 55 and the guide portions 56 provided in the sides facing the load sheave 3, it is possible to smoothly guide the load chain 4 entering between the side plates 1, 2 toward the load sheave 3 by the load chain guides 43, 44 and to force the chain 4 toward the load sheave 3 so as to mesh with the load sheave 3 effectively. Further, even though the load chain 4 is apt to deviate outwards on the rear side of each load chain guide 43, 44, namely even though the load chain 4 is apt to deviate outwards when using the manual chain block in the horizontal posture or when carrying it in the horizontal posture or the reversed posture, it is possible to restrain the deviation. Accordingly, it becomes possible to prevent the load chain from so deviating outwards as to cause interference or intertwining with the stay bolt 12 or with the attachment shaft 14 of the hook 13, so as to block or lock a smooth driving of the load sheave 3.

Further, the no-load side chain guide 44 of the load chain guides 43, 44 having the above-mentioned construction is provided with anchoring portion 45 so as to anchor the no-load side end portion of the load chain 4, it thus becomes unnecessary to provide an anchoring pin and the like especially for anchoring that no-load side end portion. In addition thereto, since the anchoring portion 45 is provided with load receiving portion 46, when a large load acts on the chain 4 at the time of excessive unwinding, the load can be received by the sufficiently durable arrangement without causing any deformation as well as it becomes possible to prevent the deformation of the no-load side portion of the load chain 4 anchored by the anchoring portion 45. Since the no-load side chain guide 44 is provided with the vertical link receiving portion 57 and the horizontal link receiving portion 58, even when the no-load side portion of the chain 4 is tensioned toward the load sheave 3 by the large load at the time of excessive unwinding, the vertical link **4*b* and the horizontal link 4*c* can be prevented from being bent and broken. In addition thereto, since the anchoring portion 45 is provided in the no-load side chain guide 44, as shown in FIG. 1, the anchoring portion 45 can be located not at such a tensioning directional position where the no-load portion of the load chain 4 is tensioned at the time of excessive unwinding but at such a remote position spaced apart relative to that tensioning direction. That is, as shown in FIG. 1, the horizontal link 4*a* at the no-load side end portion anchored by the anchoring portion 45 is anchored at a remote position spaced apart relative to the chain tensioning direction (X—X) at the time of excessive unwinding as well as the links 4*b*, 4*c* received by the vertical link receiving portion 57 and the horizontal link receiving portion 58 respectively are interposed between the horizontal link 4*a* and such a no-load side portion of the chain 4** as to be tensioned in the tensioning direction.

Therefore, when the winding operation is started from the excessive unwound state, the no-load side portion of the chain 4 is relaxed from the tensioned state to hang downward smoothly. That is, the hanging can be carried out smoothly without any interference, namely without clogging which might be caused by an interference or intertwining with the stay bolt 12 located directly below the load sheave 3 or with the chain kicker 59.

Incidentally, though the manually lifting and lowering type chain block has been explained in the above-mentioned embodiment, the present invention may be applied also to a lever type manual chain block, namely to such a lever type manual chain block as to employ an operation lever instead of the hand wheel 8 so as to rotate the load sheave 3 in the normal and reverse directions by a reciprocating operation or the lever.

Though the manual actuating device 20 employs the overload preventive mechanism 21, this overload preventive mechanism 21 is not always needed. Additionally, also the reduction gear mechanism 11 may be removed.

Further, though the driving shaft 7 is supported at its axial opposed ends by the radial bearings 18, 19 provided in the wheel cover 15 and the gear cover 16, it may be supported by the load sheave 3 or it may be supported at its one end by one of the wheel cover 15 and the gear cover 16 and at its intermediate portion by the load sheave 3.

ADVANTAGES THE INVENTION

According to the invention as set forth herein, since the anchoring portion 45 provided with the load receiving portion 46 is disposed in the no-load side chain guide 44 of the pair of load chain guides 43, 44, even in case that the no-load side portion of the load chain is excessively tensioned by an unwinding of the load chain beyond the unwinding limit or by cancellation of the traction, the no-load side end portion of the load chain is received by the load receiving portion 46. Therefore, it becomes possible to prevent a deformation of the anchoring portion 45 effectively so as to improve its durability. Further, since the anchoring portion 45 is provided in the no-load side chain guide 44, it is unnecessary to provide an anchoring member such as the anchoring pin aside from the load chain guide differently from the conventional embodiment, so that the number of component parts can be reduced by that portion, the structure can be simplified and the assembling workability can be improved so as to attain a cost decrease. Since the anchoring portion 45 is provided in the no-load side chain guide 44, it becomes possible to make the no-load side portion of the load chain guide handle smoothly when the no-load side portion of the chain is relaxed from the tensioned state by carrying out an unwinding operation. Accordingly, it becomes possible to resolve the problem that the no-load side portion of the chain clogs beside the load sheave.

According to the invention, since the vertical link receiving portion 57 and the horizontal link receiving portion 58 are provided in the no-load side chain guide 44 so as to be arranged continuously in series from the anchoring portion 45, it becomes possible to prevent a deformation of the no-load side portion of the load chain at the time of excessive tensioning thereof. Since the position of the anchoring portion 45 for anchoring the end of the no-load side portion of the load chain can be brought to the side opposed to the chain guide surface of the chain guide 44, it becomes possible to hang the no-load side portion of the chain more smoothly when the no-load side portion of the chain is made to relax in the case of unwinding the load chain 4 and so on.

According to the invention, since the chain deviation restraining portion 55 is disposed in each load chain guide 43, 44, the deviation restraining portion 55 can restrain the load chain which is apt to deviate radially outwards from the load sheave 3 due to gravity at the position where the load chain between the side plates 1, 2 passes through the load chain guide 44 in the case of conveyance of the chain block or traction of the load chain under the laid or reversed condition of the side plates 1, 2. Therefore, the load chain 4 having passed through the load sheave 3 can be kept looped around the load sheave without deviation so as to be pulled out without clogging. When the load chain is pulled out by operating the manual actuating device 20, it becomes possible to prevent the load chain from deviating and interfering with the stay bolt or to prevent the load sheave from being locked by clogging.

According to the invention, since the guide portion 56 is disposed in each load chain guide 43, 44, it is possible to correct a twist of the load chain forcibly by the guide portion 56 even though the chain approaches the load sheave 3 in the twisted state.

Accordingly, it becomes possible to prevent the chain from being clogged by catching on the fore side of each load chain guide 43, 44 in the approaching direction.

What is claimed is:

1. A load chain fixing structure in a manual chain block comprising:

a pair of side plates, spaced from each other;

a load sheave, rotatively interposed between said pair of side plates, for supporting a load chain comprising horizontal links and vertical links;

a manual driving means for driving said load sheave to wind said load chain up and down; and a pair of load chain guides, formed of block-like members and fixed between said side plates at two radial sides of said load sheave, for guiding said load chain when approaching said load sheave and for forcing the chain toward said load sheave, said load chain guides having a chain pushing surface facing said load sheave and a rear surface which opposes said chain pushing surface; wherein a retaining portion is formed on said rear surface of one load chain guide, at a non-load side of said pair of load chain guides, so as to retain a horizontal link at an end of a non-load side portion of the load chain, said retaining portion comprising a recessed portion to receive said horizontal link and being provided at its lower part with a load receiving portion, comprising a stepped portion protruding from said chain guide having a corresponding shape to that of a lower end portion of said horizontal link, such that a load acting on said horizontal link at the end of the load chain on the non-load side is transferred to said chain guide by said stepped portion in contact with the lower end portion of said horizontal link received in said recessed portion, said retaining portion being also provided with fixing means for fixing said horizontal link which is received in said recessed portion, to said retaining portion.

2. A manual chain block as set forth in claim 1, wherein said no-load side chain guide also has a vertical link receiving portion adapted to receive a vertical link connected to the no-load side end portion anchored to the anchoring portion.

3. A manual chain block as set forth in claim 2, wherein each said chain guide has a guide portion disposed so as to face the load sheave on a fore side in the approaching direction of the load chain relative to the load sheave so as to correct a twist of the load chain coming up to the load sheave.

4. A manual chain block as set forth in claim 1, wherein each said chain guide has a chain deviation restraining portion disposed so as to face the load sheave on the rear side in an approaching direction of the load chain relative to the load sheave so as to serve to restrain a radially outward deviation of the chain relative to the load sheave on that rear side.

5. A manual chain block as set forth in claim 4, wherein each said chain guide has a guide portion disposed so as to face the load sheave on a fore side in the approaching direction of the load chain relative to the load sheave so as to correct a twist of the load chain coming up to the load sheave.

6. A manual chain block as set forth in claim 1, wherein each said chain guide has a guide portion disposed so as to face the load sheave on a fore side in the approaching direction of the load chain relative to the load sheave so as to correct a twist of the load chain coming up to the load sheave.

* * * * *